US006204739B1

(12) United States Patent
Sakamoto et al.

(10) Patent No.: US 6,204,739 B1
(45) Date of Patent: Mar. 20, 2001

(54) DIELECTRIC RESONANT APPARATUS

(75) Inventors: Koichi Sakamoto, Otsu; Takatoshi Kato, Mino; Kenichi Iio, Nagaokakyo; Sadao Yamashita, Kyoto, all of (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 09/256,258

(22) Filed: Feb. 23, 1999

(30) Foreign Application Priority Data

Feb. 24, 1998 (JP) ..... 10-042017

(51) Int. Cl.[7] ..... H01P 7/10; H01P 1/20; H01P 5/12

(52) U.S. Cl. ..... 333/219.1; 333/204; 333/134

(58) Field of Search ..... 333/219.1, 202, 333/204, 134

(56) References Cited

U.S. PATENT DOCUMENTS 5,786,740 * 7/1998 Ishikawa et al. ..... 333/219.1
5,945,894 * 1/2000 Ishikawa et al. ..... 333/219.1
6,016,090 * 1/2000 Iio et al. ..... 333/202

FOREIGN PATENT DOCUMENTS

0734084 A1 9/1996 (EP) .
0764996 A1 3/1997 (EP) .

OTHER PUBLICATIONS

Nihad L. Dib et al., Characterization of Non–Symmetric Coplanar Waveguide Disconuities, 6/1/92, pp. 99–102, 1992 IEEE MTT–S Digest.

Ikou AW AII, et al., A Dal Mode Dielectric Waveguide Resonator and Its Applications to Bandpass Filters, Aug. 1995, pp. 1018–1025, IEICE Transactions on Electronics.

* cited by examiner

*Primary Examiner*—Robert Pascal
*Assistant Examiner*—Patricia T. Nguyen
(74) *Attorney, Agent, or Firm*—Ostrolenk, Faber, Gerb & Soffen, LLP

(57) ABSTRACT

Electrodes are formed on respective two main surfaces of a dielectric sheet wherein each electrode has an opening formed at a location corresponding to the location of the opening formed in the other electrode. The part defined by the openings serves as a dielectric resonator. Coupling lines are formed directly in the electrode opening. Transmission lines are formed on a circuit board. The coupling lines and the corresponding transmission lines are connected to each other via bonding wires. This structure makes it possible to minimize the external Q of a resonant circuit using the dielectric resonator. If an oscillator is produced using this resonant circuit, it is possible to achieve a large frequency modulation with and large output.

6 Claims, 10 Drawing Sheets

DIELECTRIC RESONANT APPARATUS

CROSS-REFERENCE TO RELATED APPLICATION

The application is related to U.S. patent application Ser. No. 08/965,464 filed Nov. 21, 1997, now U.S. Pat. No. 6,016,090 the disclosures of which are incorporated by reference herein.

BACKGROUND OF THE INVENTION

1. Field of the Invention

The present invention relates to a dielectric resonant apparatus, and more particularly to a dielectric resonant apparatus for use in the microwave or millimeter wave range.

2. Description of the Related Art

A dielectric resonator having low phase noise and high stability of resonant frequency is used as a resonator or in an oscillator in a high-frequency range such as a microwave or millimeter wave range.

In Laid-open Japanese Patent Application No. 8-265015, the assignee of the present application has presented a module in which electrodes are arranged on both main surfaces of a dielectric sheet to form a dielectric resonator on a part of the sheet. The electrodes arranged on the dielectric sheet serve as ground potentials; and a microstrip arranged on another dielectric sheet is stacked on the dielectric sheet. This arrangement is used in a high-frequency module such as a VCO.

In addition, a similar type of high-frequency module has been presented in Japanese Patent Application No. 8-294087 and the co-pending U.S. patent application Ser. No. 08/965,464. FIGS. 19 and 20 illustrate the structure of the high-frequency module. Is should be noted that this high-frequency module was not laid-open to the public at the time of filing of the Japanese Application No. 10-42017 on which the present application is based. Thus, the inventors do not deem the high-frequency module of FIGS. 19–20 to be prior art with respect to the present invention.

In FIG. 19, reference numeral 1 denotes a dielectric sheet. An electrode is formed on each of two main surfaces of the dielectric sheet 1. Each electrode has an opening formed at a location corresponding to the location of the opening of the other electrode (reference numeral 4 denotes one opening). The part defined by the electrode openings serves as a dielectric resonator. A circuit board 6, on a surface of which a circuit including microstrip lines is formed, is placed on the upper surface of the dielectric sheet 1. On the circuit board 6, there are also provided coupling lines 11 and 12 at locations which allow the coupling lines 11 and 12 to be coupled with the dielectric resonator formed in the electrode openings 4.

In the example shown in FIG. 20, electrodes each having an opening formed at locations corresponding to each other (reference numeral 5 denotes an opening formed in one electrode) are disposed on two respective main surfaces of a dielectric sheet 1 such that the part defined by the electrode openings serves as a dielectric resonator. The dielectric sheet 1 is placed on a circuit board 6 such that the dielectric resonator is coupled with a transmission line 11 or 12 formed on the circuit board 6. A spacer is disposed between the dielectric sheet 1 and the circuit board 6 so that electrodes on the lower surface, in FIG. 20, of the dielectric sheet 1 are insulated from the electrodes 11 and 12 on the upper surface of the circuit board 6.

In dielectric resonators of the types described above in which electrodes each having an opening formed at locations corresponding to each other are disposed on respective two main surfaces of a dielectric sheet, almost all electromagnetic field is confined in the part defined by the electrode openings and thus electromagnetic energy is concentrated in that part. Therefore, strong coupling can be achieved by placing the coupling line at a proper location. Thus, the dielectric resonator can be used, for example, to realize an oscillator having a large oscillation frequency modulation width and/or large output power.

In the oscillators shown in FIGS. 19 and 20, the frequency modulation width varies depending on the external Q (Qe2) of the resonant circuit (coupling line 12) as shown in FIG. 16. As can be seen from FIG. 16, it is possible to greatly increase the frequency modulation width by reducing the external Q (Qe2).

FIG. 17 illustrates the relationship between the reflection coefficient of the resonant circuit and the external Q (Qe1) of the dielectric resonator and the band-reflection coupling line 11. From FIG. 17, it can be seen that the reflection coefficient of the resonant circuit increases if the external Q (Qe1) is reduced. Because the output increases with the increase in the reflection coefficient of the resonant circuit, it is possible to increase the output by reducing the external Q (Qe1).

FIG. 2 illustrates an electromagnetic field distribution in a dielectric resonator of the type in which the resonator is formed on a dielectric sheet in the manner described in FIG. 19 or 20. In FIG. 2, reference numerals 2 and 3 denote electrodes formed on the respective main surfaces of the dielectric sheet 1. The part defined in the circular openings 4 and 5 of the respective electrodes 2 and 3 serves as a TE010-mode dielectric resonator. In the conventional resonant circuit for use in an oscillator, the coupling lines 11 and 12 are disposed at locations slightly apart from the surfaces of the electrode openings 4 and 5 (hereinafter referred to as electrode opening planes) forming the dielectric resonator part. If the distance between the coupling lines and the electrode opening plane is increased, the electromagnetic field applied to the coupling lines decreases rapidly as can be seen from FIG. 2. This means that the degree of coupling decreases rapidly with the increase in the distance between the coupling lines and the electrode opening plane.

FIG. 18 illustrates the oscillation output as a function of the distance between the coupling lines and the electrode opening plane (wherein the distance is measured in a direction perpendicular to the electrode opening plane). As can be seen from FIG. 18, if the distance between the coupling lines and the electrode opening plane is reduced, then the external Q decreases and the output increases.

However, in the dielectric resonant apparatus shown in FIG. 19 or 20, it is impossible to reduce the distance between the coupling lines and the electrode opening to a value smaller than a practical limit. That is, in the example shown in FIG. 19, in order to decrease the distance from the electrode opening plane of the electrode opening 4 to the coupling lines 11 and 12, it is required to decrease the thickness of the circuit board 6 because the coupling lines 11 and 12 are disposed on the upper surface of the circuit board 6. However, the reduction in the thickness of the circuit board 6 is limited to a practically-possible minimum value. In the example shown in FIG. 20, it is required to reduce the thickness of the spacer. However, the spacer also has its minimum possible thickness. Besides, the reduction in the thickness of the spacer results in another problem that it becomes impossible to obtain a desired characteristic because the reduction in the thickness of the spacer produces a great change in the characteristic impedance of the lines 11 and 12.

Still another problem is the positioning accuracy of the coupling lines relative to the resonator. In the millimeter range, a very small change in the location of the coupling lines relative to the location of the resonator results in a large change in the characteristic. Therefore, high positioning accuracy is required. However, in the conventional dielectric resonant apparatus, the resonator and the coupling lines are produced separately by different processes, and thus it is difficult to achieve a required high positional accuracy.

It is an object of the present invention to provide a dielectric resonant apparatus including a resonant circuit using a dielectric resonator with a reduced external Q so that the dielectric resonant apparatus may be used, for example, to realize an oscillator having a large frequency modulation width and large output.

It is another object of the present invention to provide a dielectric resonant apparatus having high positional accuracy between a resonator and a coupling line and thus having a small characteristic variation.

SUMMARY OF THE INVENTION

According to an aspect of the present invention, there is provided a dielectric resonant apparatus including a dielectric resonator including electrodes formed on respective two main surfaces of a dielectric sheet, each electrode having an opening formed at a location corresponding to the location of the opening formed in the other electrode, the dielectric resonant apparatus being characterized in that: a coupling line coupled with the dielectric resonator is disposed in at least one of openings formed at locations corresponding to each other so that the distance between the electrode opening plane and the coupling line is properly reduced; and a transmission line is formed outside the above-described at least one of openings and the transmission line is electrically connected to the coupling line.

In this construction, the coupling line is formed directly in the electrode opening plane and thus it is possible to realize strong coupling between the coupling line and the dielectric resonator.

If the transmission line is constructed into the form of a coplanar line using, as a ground electrode, one of the electrodes formed on the dielectric sheet, it is possible to form, at the same time, the transmission line, the coupling line, and the electrodes on the dielectric sheet such that the dielectric resonator part is formed thereon without having to use an additional substrate.

On the surface of the above-described sheet, there may be disposed another dielectric sheet or dielectric film on which a microstrip line serving as the above-described transmission line is formed. In this construction, when transmission lines other than the coupling line are formed into the structure of microstrip lines, it is possible to achieve strong coupling between the coupling line and the dielectric resonator.

The connection between the transmission line and the coupling line may be realized via a conductor formed on an interconnecting member disposed on the surface of the dielectric sheet wherein the conductor formed on the interconnecting member is insulated from the electrode on the main surface of the dielectric sheet. In this structure, the connection between the transmission line and the coupling line can be easily achieved by mounting the interconnecting member on the surface of the dielectric sheet in a similar manner employed to mount other chip-shaped components.

When the coupling line and the transmission line are formed on the dielectric sheet, the center conductor of the coplanar line may be formed such that the center conductor of the coplanar line and the coupling line are formed of a single one line. In this structure, no additional interconnection for the connection between the coupling line and the transmission line is required.

Furthermore, two ground electrodes located at both sides of the center conductor of the coplanar line may be connected to each other via a conductor extending over the center conductor. In this case, it is possible to vary the resonance frequency of the dielectric resonator by adjusting the location of the conductor via which the two ground electrodes are connected to each other.

DESCRIPTION OF THE PREFERRED EMBODIMENT

Figure 1:
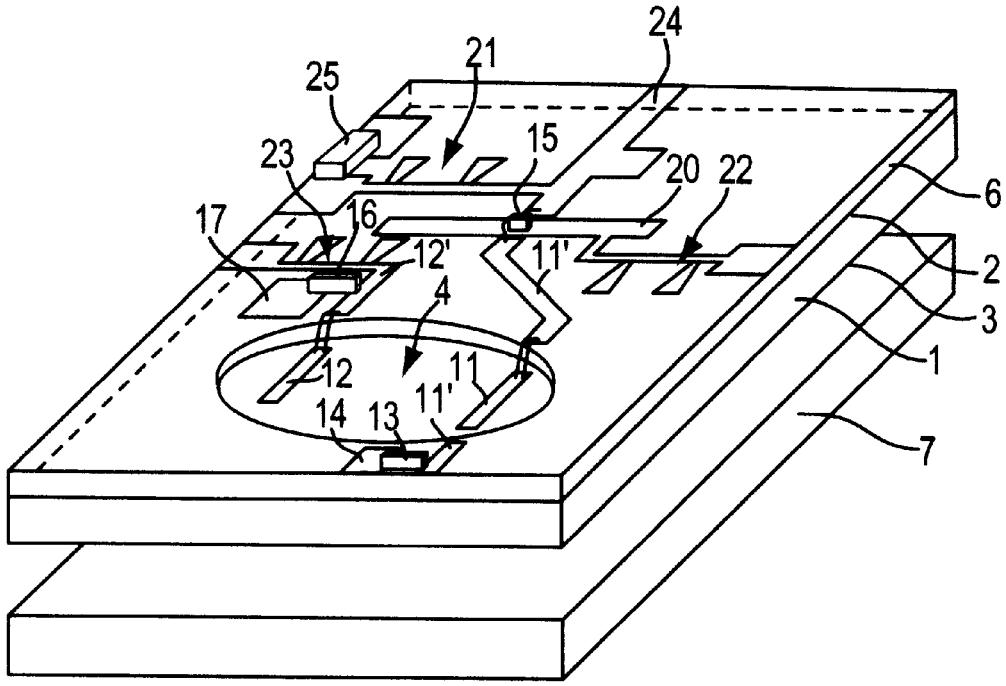
FIG. 1 is a perspective view of a main part of a VCO according to an embodiment of the present invention.
Figure 2:
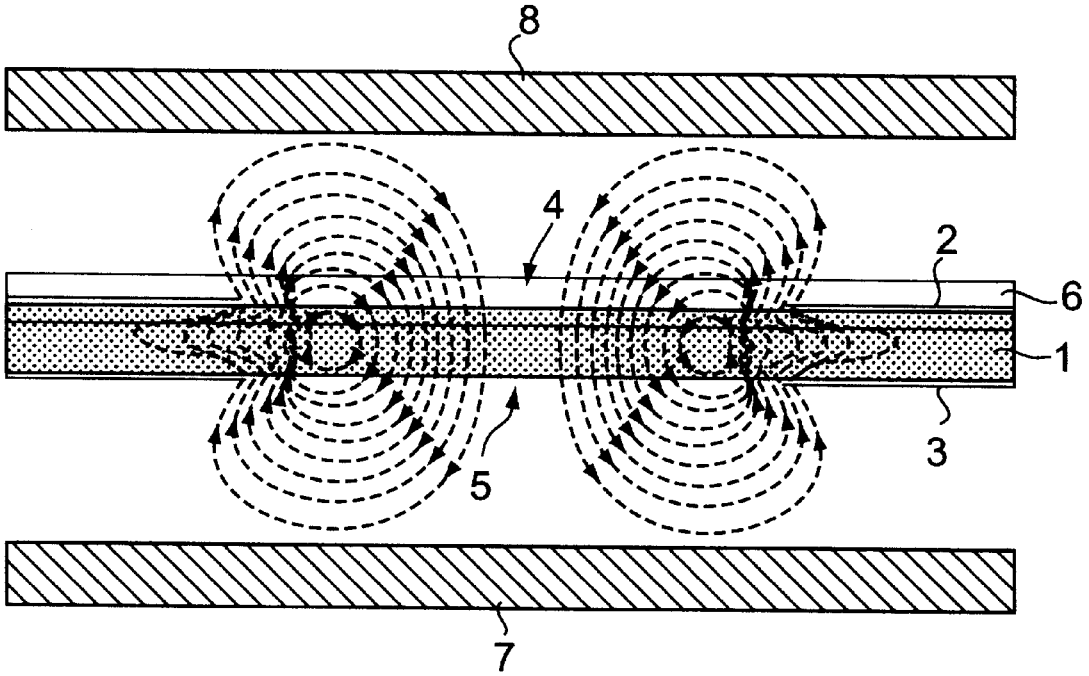
FIG. 2 is a cross-sectional view illustrating an example of an electromagnetic field distribution in a dielectric resonator.
Figure 3:
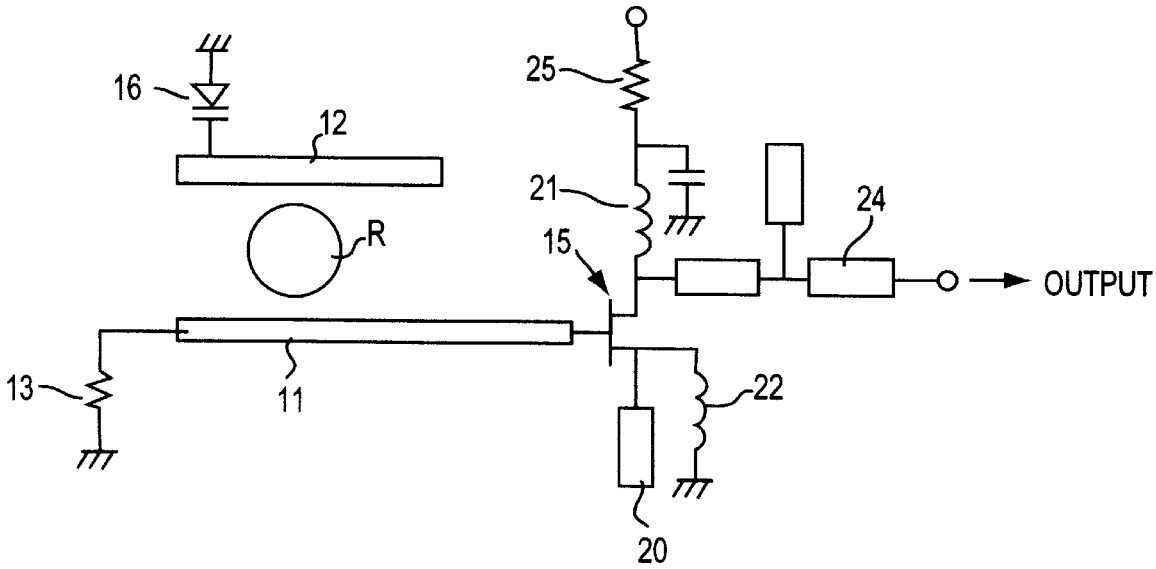
FIG. 3 is an equivalent circuit diagram of the VCO.

Referring to FIGS. 1 to 3, a first embodiment of a voltage controlled oscillator (hereinafter referred to as a VCO) according to the present invention is described below.

FIG. 1 is a partial perspective view of a VCO module. In FIG. 1, reference numeral 1 denotes a dielectric sheet. Electrodes 2 ad 3 are formed on the respective two main surfaces of the dielectric sheet 1. Each electrode 2, 3 has an opening formed at a location corresponding to the location of the opening of the other electrode. In FIG. 1, reference numeral 4 denotes an opening formed in the electrode disposed on the upper surface of the dielectric sheet 1. Reference numeral 6 denotes a circuit board in the form of a dielectric sheet having an opening formed at a location corresponding to the electrode opening 4. Various circuits are formed on the upper surface of the circuit board 6, as described below. They include a transmission line 11' connected to a coupling line 11 formed in the electrode opening 4 and a transmission line 12' connected to a coupling line 12 formed in the electrode opening 4. A terminating resistor 13 is provided between one transmission line 11' and a ground electrode 14. On the other hand, a varactor diode 16 is disposed between the transmission line 12' and a ground electrode 17. Furthermore, a bias circuit 23 is connected to an end of the transmission line 12'.

There is also provided a series feedback line 20, on which an FET 15 is mounted. Reference numeral 24 denotes an output circuit. The gate of the FET 15 is connected to an end of the transmission line 11'. The drain and the source of the FET 15 are connected to the series feedback line 20 and the output circuit 24, respectively. A bias circuit 22 is connected to the series feedback line 20, and a bias circuit 21 is connected to the output circuit 24. Furthermore, a chip resistor 25 is disposed between the end of the bias circuit 21 and the ground electrode.

Because the back surface of the circuit board 6 is in contact with the ground electrode formed on the upper surface of the dielectric sheet 1, microstrip lines are formed between the respective transmission lines described above and the ground electrode. Alternatively, a ground electrode may be formed over the substantially entire area of the back surface (facing the dielectric sheet 1) of the circuit board 6.

The coupling lines 11 and 12 are formed on the upper surface of the dielectric sheet 1, in an area exposed via the electrode opening. The coupling electrodes 11 and 12 are connected via bonding wires to the electrodes 11' and 12', respectively, formed on the circuit board 6.

FIG. 2 is a cross-sectional view illustrating an electromagnetic field distribution in the dielectric resonator part. As described above, the electrodes 2 and 3 having circular electrode-openings 4 and 5 formed at locations corresponding to each other are disposed on both main surfaces of the dielectric sheet 1 so that the part defined by the openings 4 and 5 serves as a TE010-mode dielectric resonator. In the TE010 mode, the intensity of the electromagnetic field is greater at locations nearer to the surface of the dielectric sheet 1 in the vicinity of the electrode openings 4 and 5.

FIG. 3 illustrates an equivalent circuit of the VCO described above. In this figure, R denotes the dielectric resonator. The FET 15 forms a negative resistance circuit. The negative resistance circuit, the coupling line 11, and the dielectric resonator R coupled with the coupling line 11 form a band reflection oscillator. The oscillation frequency changes according to the capacitance of the varactor diode 16 connected to the coupling line 12 coupled with the dielectric resonator R.

By forming the coupling line directly in the electrode opening plane in the above-described manner, it is possible to achieve strong coupling between the dielectric resonator and the coupling line. Furthermore, in this technique, because the electrode opening forming the dielectric resonator and the coupling line are formed on the same single dielectric sheet, it is possible to easily achieve high positional accuracy between the dielectric resonator and the coupling line. As a result, it is possible to easily produce dielectric resonant apparatuses with less characteristic variations.

Figure 4:
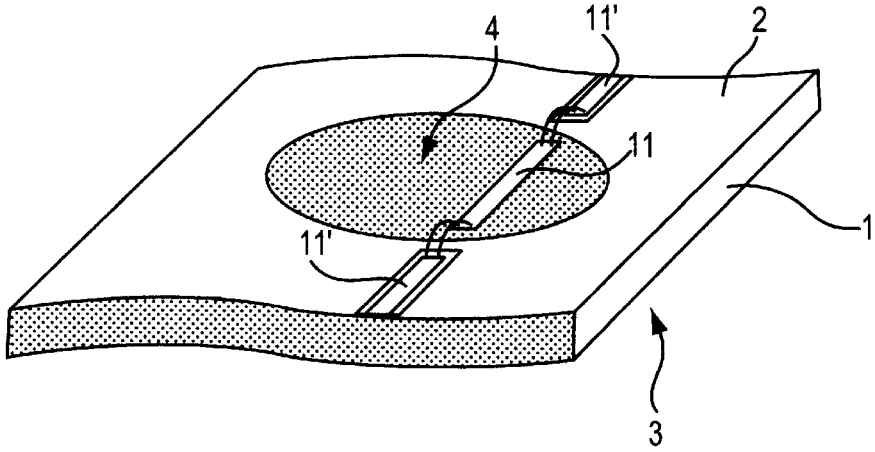
FIG. 4 is a perspective view illustrating an example of a construction of a main part of a dielectric resonant apparatus using a coplanar transmission line.

Although in the first embodiment, the transmission lines are formed into the microstrip line structure, they may also be formed into the coplanar line structure. FIG. 4 illustrates an example in which a coplanar line is employed. In FIG. 4, of the electrodes formed in the electrode opening, only a coupling line 11 is shown. In FIG. 4, an electrode 2 having a circular opening 4 and a coplanar transmission line including a center conductor 11' are formed on the upper surface of the dielectric sheet 1. The center conductor 11' of the coplanar transmission line and the coupling line 11 are connected to each other via a bonding wire. When the transmission lines are produced into the form of coplanar transmission lines in the above-described manner, the circuit board 6 such as that shown in FIG. 1 becomes unnecessary at least for the transmission lines. Because the ground electrode, the transmission lines, and the coupling lines can all be formed on the dielectric sheet, the required production process becomes simpler. Furthermore, high positional accuracy between the dielectric resonator and the coupling line can be easily achieved.

Figure 5:
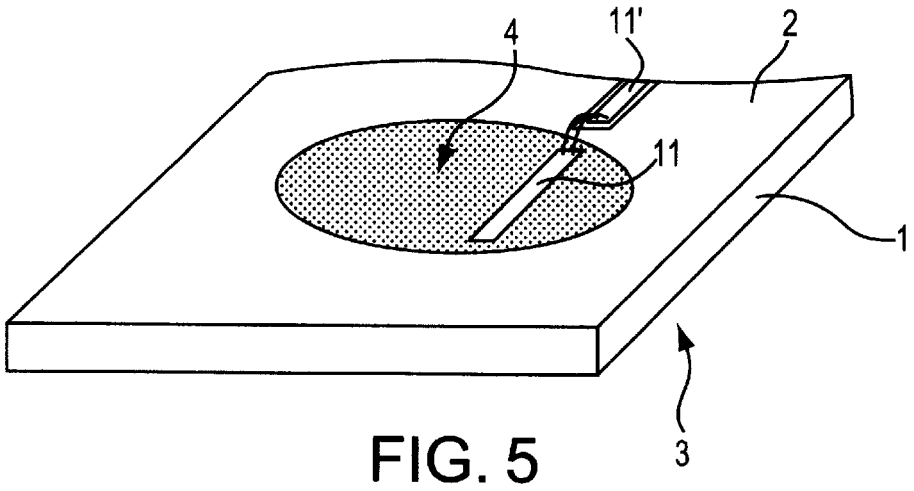
FIG. 5 is a perspective view illustrating another example of a construction of a main part of a dielectric resonant apparatus using a coplanar transmission line.

Instead of employing the bonding wire shown in FIG. 4, the connection may also be achieved using a ribbon wire as shown in FIG. 5.

Figure 6:
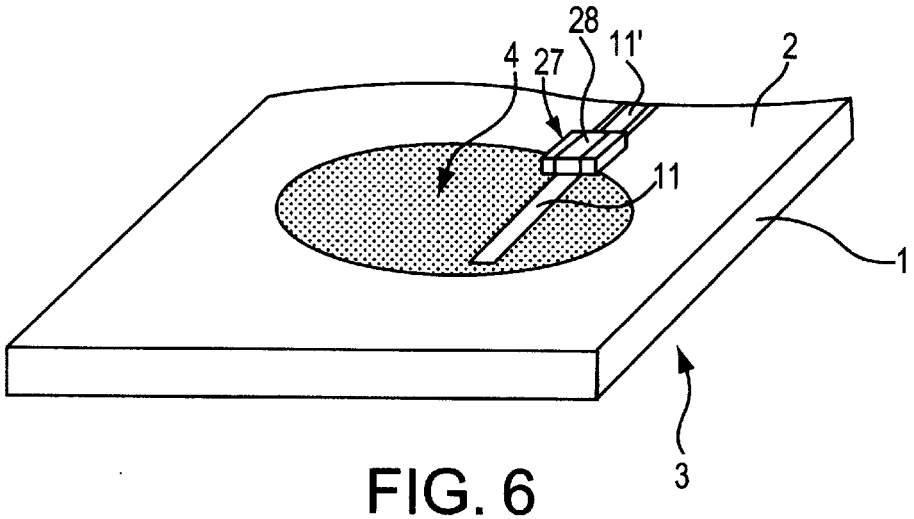
FIG. 6 is a perspective view illustrating still another example of a construction of a main part of a dielectric resonant apparatus using a coplanar transmission line.

Alternatively, as shown in FIG. 6, an interconnecting member including a conductor 28 may be disposed between the coupling line 11 and the end of the coplanar transmission line such that the center conductor 11' of the coplanar transmission line is connected to the coupling line 11 via the conductor 28.

Figure 7:
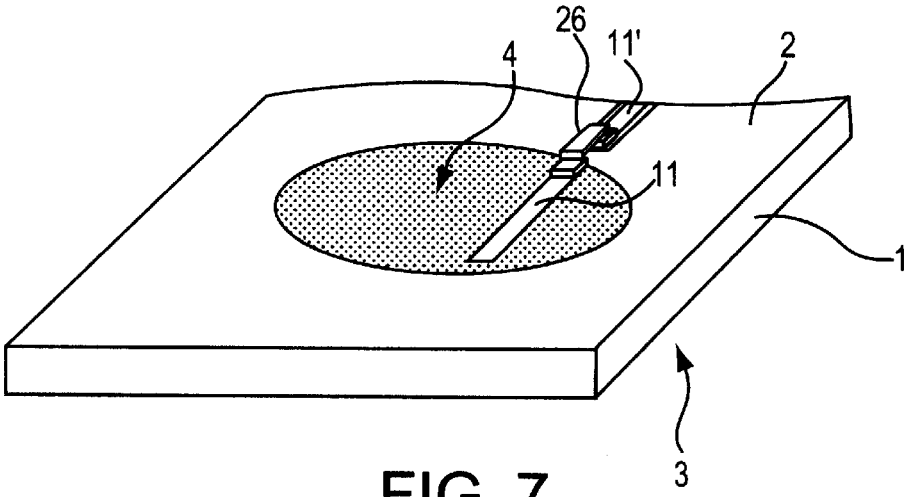
FIG. 7 is a perspective view illustrating still another example of a construction of a main part of a dielectric resonant apparatus using a coplanar transmission line.

Still alternatively, as shown in FIG. 7, the coupling line 11 may be connected to the center conductor 11' of the coplanar transmission line via an air bridge 26.

Figure 8:
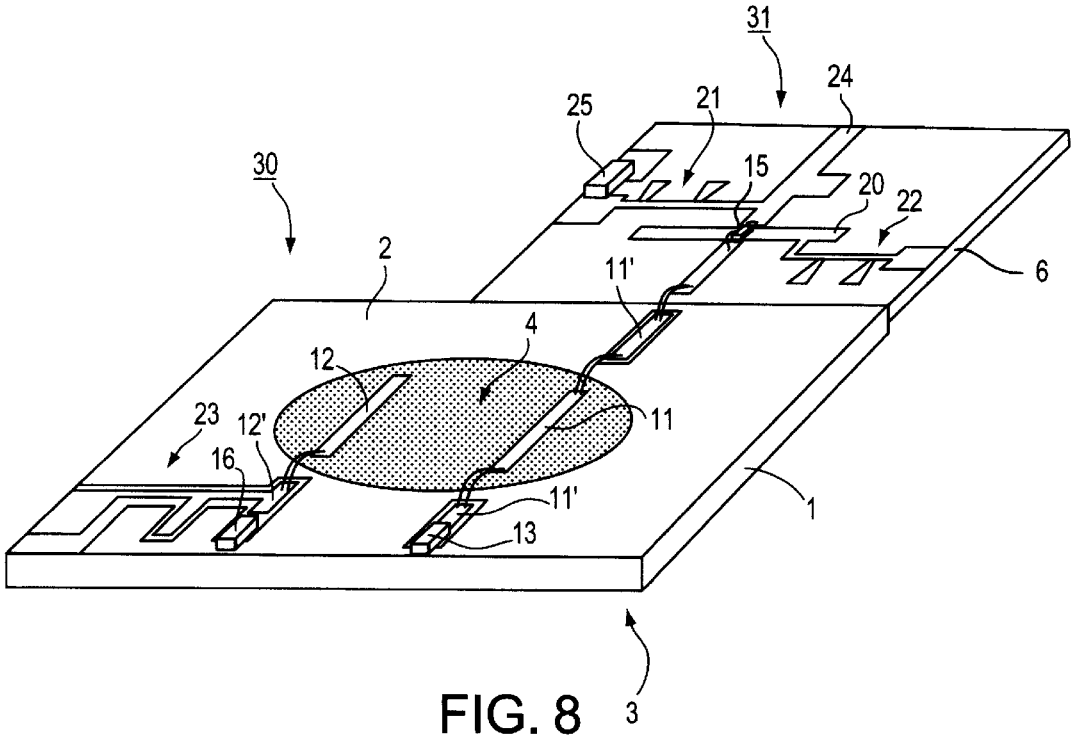
FIG. 8 is a perspective view illustrating an example of a construction of a main part of a VCO using a transmission line in the form of a coplanar transmission line.

FIG. 8 illustrates an example of a VCO constructed using transmission lines in the form of coplanar transmission lines. In FIG. 8, reference numeral 30 denotes a resonant circuit board including a dielectric sheet 1 wherein electrodes 2 and 3 having openings formed at locations corresponding to each other are disposed on the respective two main surfaces of the dielectric sheet 1 so as to form a TE010-mode dielectric resonator part. Furthermore, coupling lines 11 and 12 and various transmission lines including transmission lines 11' and 12' in the form of coplanar transmission lines are formed on the upper surface of the dielectric sheet 1. Reference numeral 31 denotes a negative resistance circuit board. A ground electrode is formed over the substantially entire area of the lower surface of a dielectric sheet. A negative resistance circuit including an FET 15 is formed on the upper surface of the dielectric sheet. This negative resistance circuit is constructed in a similar fashion to the negative resistance circuit shown in FIG. 1.

In the resonant circuit board 30, a terminating resistor 13 is disposed on the upper surface of the dielectric sheet 1 such that the transmission line 11' is connected, via the terminating resistor 12, to the electrode 2 serving as the ground electrode. Furthermore, a varactor diode 16 is disposed between the transmission line 12' and the ground electrode. The transmission line 12' is also connected to a bias circuit 23. When both coplanar lines and microstrip lines are used as is the case in this example, the resonant circuit board and the negative resistance circuit board may be produced separately and the transmission lines on the two board may be connected via a bonding wire.

Figure 9:
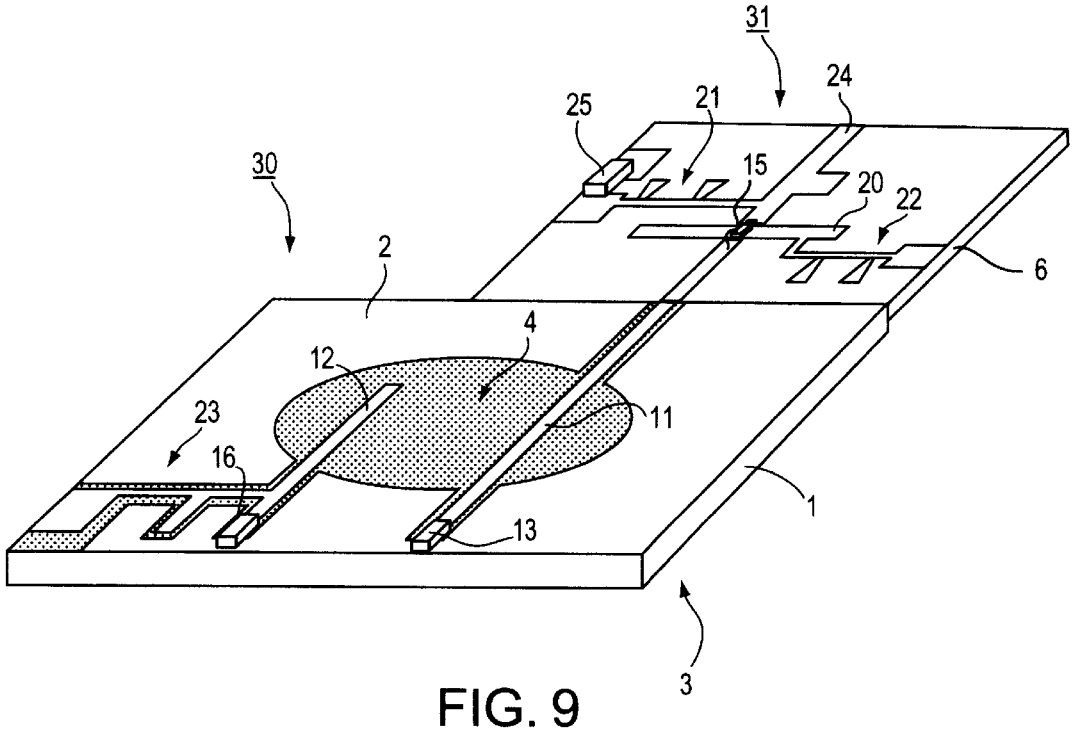
FIG. 9 is a perspective view illustrating another example of a construction of a main part of a VCO using a transmission line in the form of a coplanar transmission line.

FIG. 9 illustrates another example of a VCO constructed using transmission lines in the form of coplanar transmission lines. A negative resistance circuit board 31 is similar to that shown in FIG. 8. A resonant circuit board 30 is different from that shown in FIG. 8 in that coupling lines 11 and 12 are extended into an outer area from the inside of an electrode opening 4 such that the extended parts act as coplanar transmission lines. In other words, the center conductors of the coplanar transmission lines and the coupling lines are formed of the same continuous lines. In this structure, the wire bonding for the connection between the coupling lines and the transmission lines become unnecessary. As for the connection between the transmission line on the resonant circuit board 30 and that on the negative resistance circuit board 31, the transmission lines may be directly connected using solder or the like without using a bonding wire.

Figure 10:
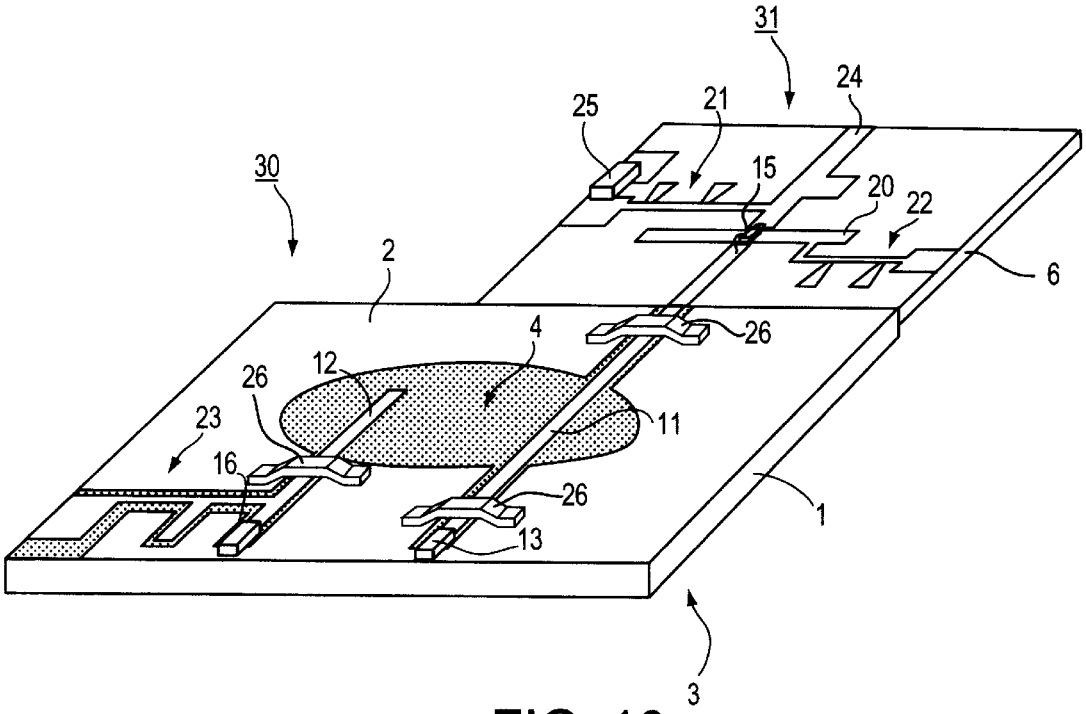
FIG. 10 is a perspective view illustrating still another example of a construction of a main part of a VCO using a transmission line in the form of a coplanar transmission line.

FIG. 10 is a perspective view illustrating another example of a VCO constructed using transmission lines in the form of coplanar transmission lines. In FIG. 10, reference numeral 26 denotes air bridges extending over center conductors of coplanar transmission lines extending from the coupling lines 11 and 12 such that two ground electrodes (electrodes 2) at both sides of the center conductors are connected to each other via the air bridges. By disposing air bridges 26 around the perimeter of the electrode opening 4 such that the resultant structure becomes equivalent to the structure shown in FIG. 8 in which the electrode opening is surrounded by a continuous ground conductor, thereby ensuring that oscillation occurs at an intrinsic resonant frequency. If the locations of the air bridges 26 are shifted far from the perimeter of the electrode opening 4, the electromagnetic field distribution near the perimeter of the electrode opening changes and thus the resonant frequency changes (decreases). This effect allows the resonant frequency to be set or adjusted by the locations of the air bridges 26.

Instead of the air bridges 26 shown in FIG. 10, bonding wires or ribbon wires may be used to make connections between the ground electrodes at both sides of the center conductors of the coplanar transmission lines. Alternatively, the bridges may be formed using a two-layer interconnection technique.

Figure 11:
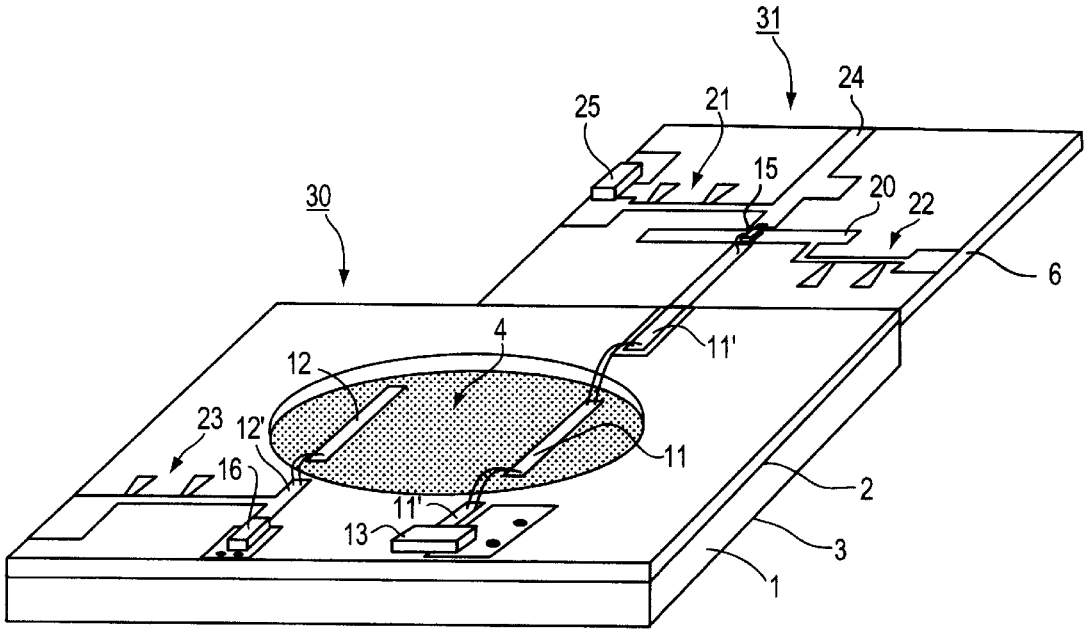
FIG. 11 is a perspective view illustrating an example of a construction of a VCO using a transmission line in the form of a microstrip line.

Although coplanar transmission lines are employed in the examples shown in FIGS. 8 to 10, the circuit may also be divided into two modules, that is, a resonant circuit board 30 and a negative resistance circuit board 31, as shown in FIG. 11 when transmission lines are produced using microstrip lines. In FIG. 11, a dielectric resonator formed in resonant circuit electrode openings 4, coupling lines 11 and 12 coupled with the dielectric resonator, and transmission lines 11' and 12' connected to the respective coupling lines 11 and 12 are all similar to those shown in FIG. 1 although there are differences in locations. A negative resistance circuit board 31 is similar to that shown in FIG. 8. By dividing the circuit into the resonant circuit module and the negative resistance circuit module as described above, it becomes possible to separately produce and adjust those two modules.

Figure 12:
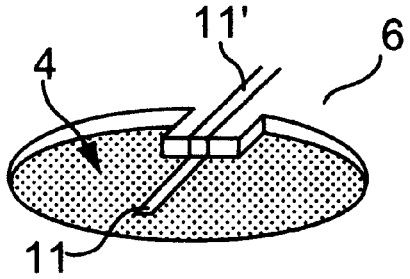
FIG. 12 is a partial perspective view illustrating the structure of a connecting part between a coupling line and a microstrip line.

FIG. 12 illustrates another technique to connect a microstrip line formed on a circuit board 6 to a coupling line formed on a dielectric sheet in an electrode opening. In this example, the circuit board 6 includes an opening formed at a location corresponding to the electrode opening 4 formed on the dielectric sheet, and the circuit board 6 partially protrudes into the opening such that the end of the protruding part reaches an end of the coupling line 11 formed in the electrode opening. The transmission line 11' in the microstrip line form and the coupling line 11 are connected to each other at the protruding part via solder or the like. Instead of using solder, the connection may also be achieved via capacitance between the transmission line 11' and the coupling line 11.

Figure 13:
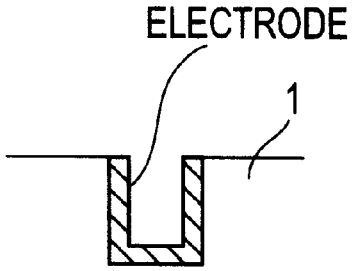
FIG. 13 is a cross-sectional view illustrating another example of the construction of a coupling line.

In the above examples, the coupling lines are simply formed on the surface of the dielectric sheet 1 in the electrode opening. Alternatively each coupling line may be formed into a trench structure as shown in FIG. 13. Such a trench coupling line may be obtained by forming a trench at a location where a coupling line is to be formed and then forming an electrode on the inner surface of the trench. By employing such an electrode structure, it is possible to reduce the conductor loss and thus increase Qo of the dielectric resonator.

Figure 14:
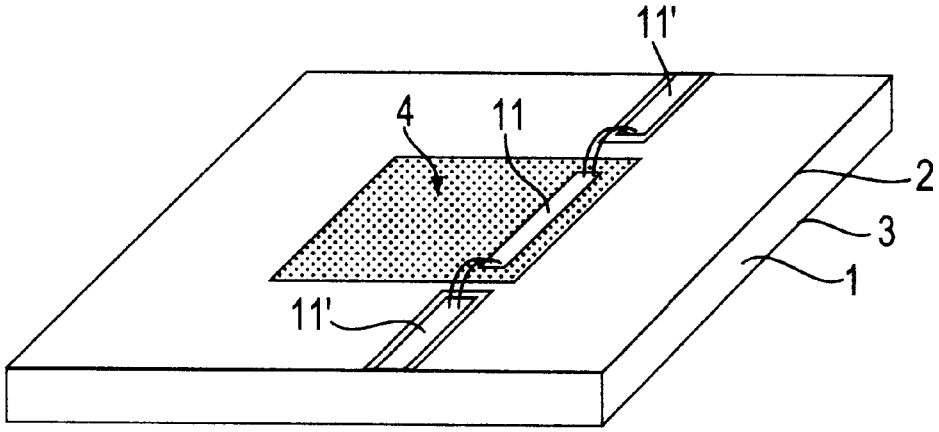
FIG. 14 is a perspective view of a main part of a dielectric resonant apparatus using a PDTL-mode dielectric resonator.

In the embodiments described above, a circular electrode opening is formed to realize a TE010-mode dielectric resonator. Alternatively, a rectangular electrode opening may be formed so as to realize a rectangular slot-mode resonator, as shown in FIG. 14. In this mode, a planar dielectric transmission line acts as a resonator and thus this mode may be called a PDTL mode.

Figure 15A:
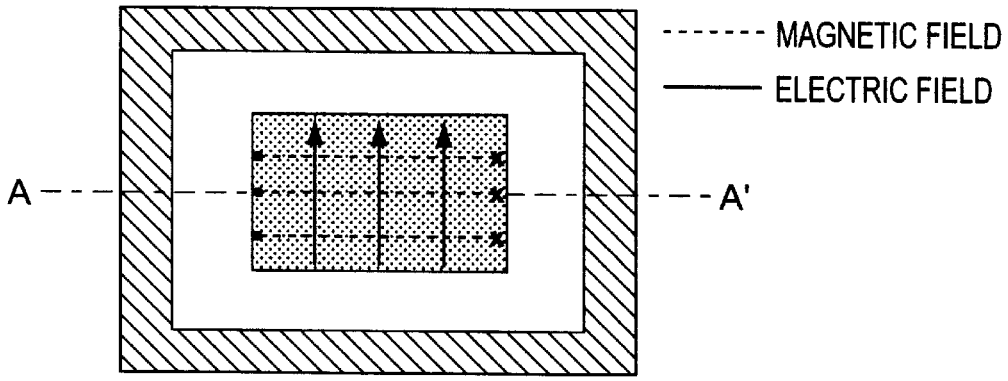
FIGS. 15A and 15B illustrate an example of an electromagnetic field distribution in a PDTL mode.
Figure 15B:
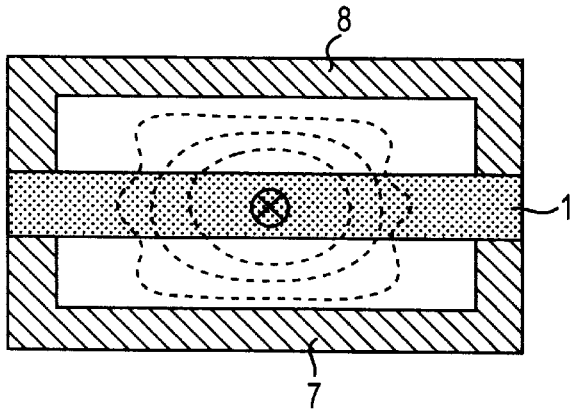
Figure 16:
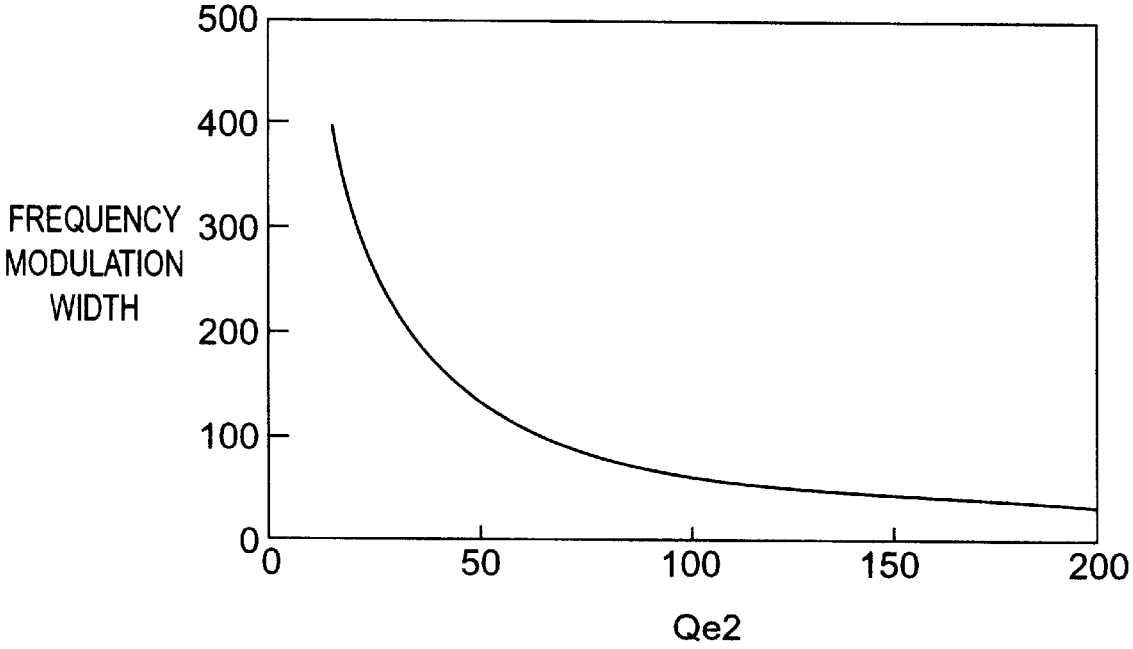
FIG. 16 is a graph illustrating the relationship between the frequency modulation width of an oscillator and the degree of coupling.
Figure 17:
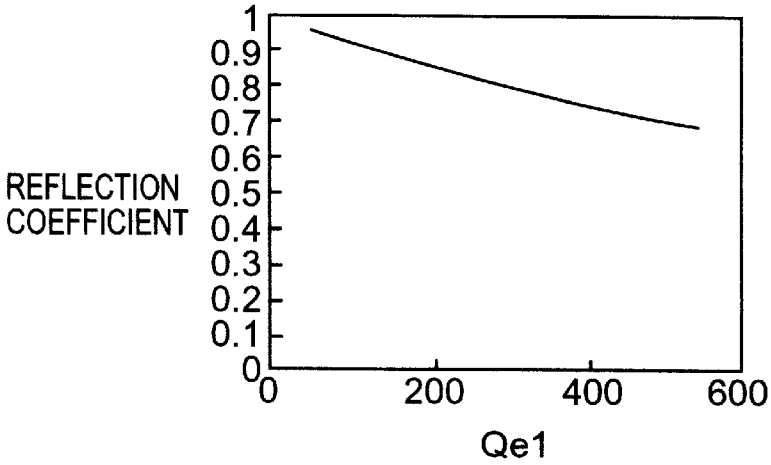
FIG. 17 is a graph illustrating the relationship between the reflection coefficient of a resonant circuit and the external Q.
Figure 18:
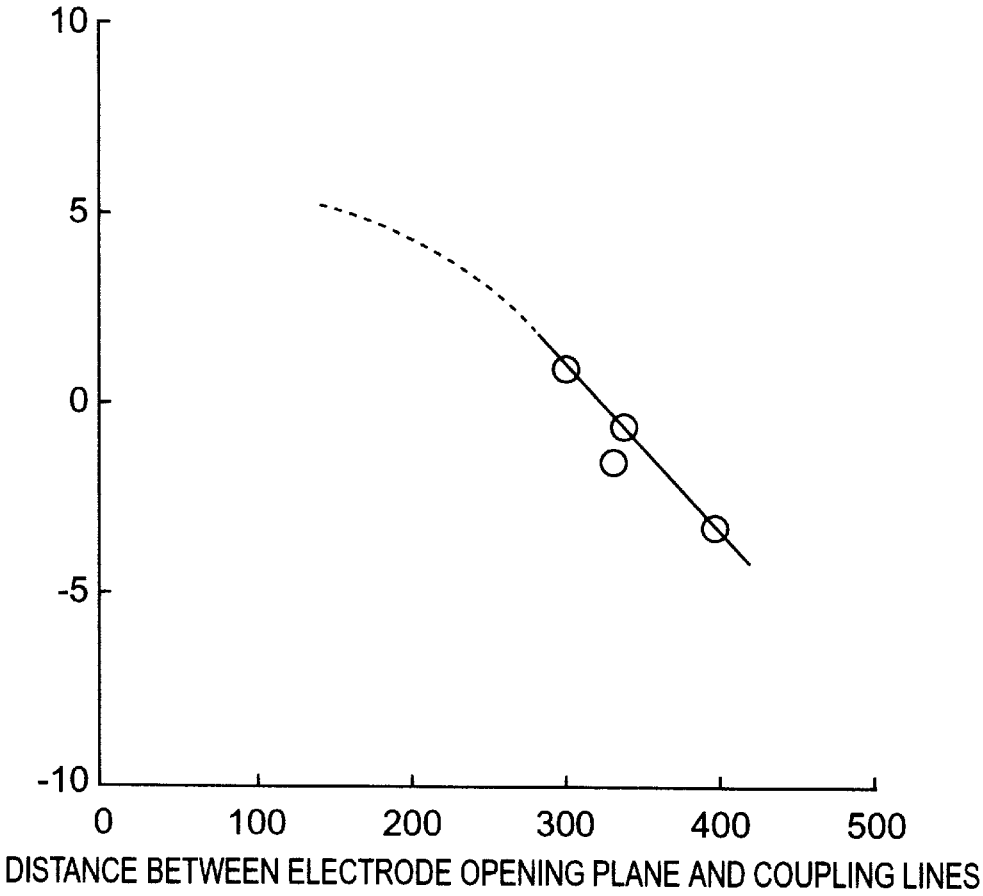
FIG. 18 is a graph illustrating the dependence of the output of an oscillator on the distance between an electrode opening plane and a coupling line.
Figure 19:
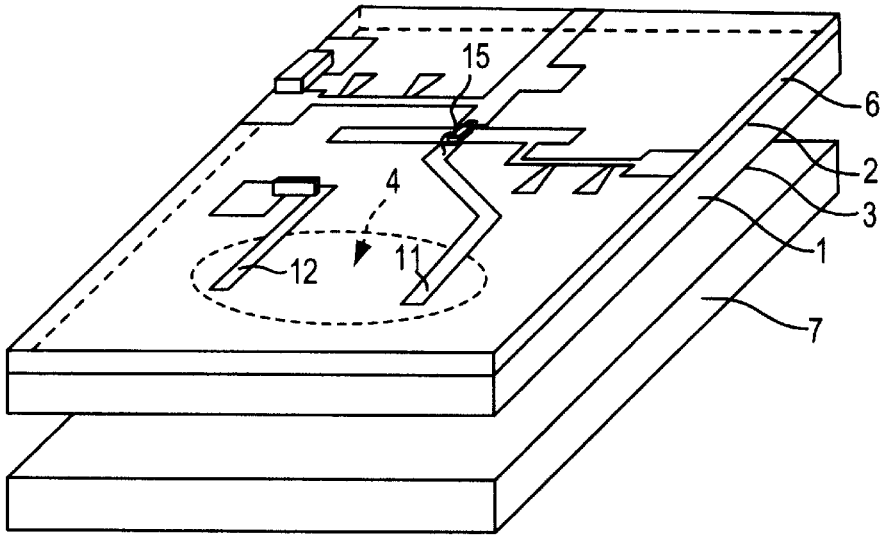
FIG. 19 PRIOR ART
FIG. 19 is a partial perspective view illustrating an example of the construction of a conventional VCO.
Figure 20:
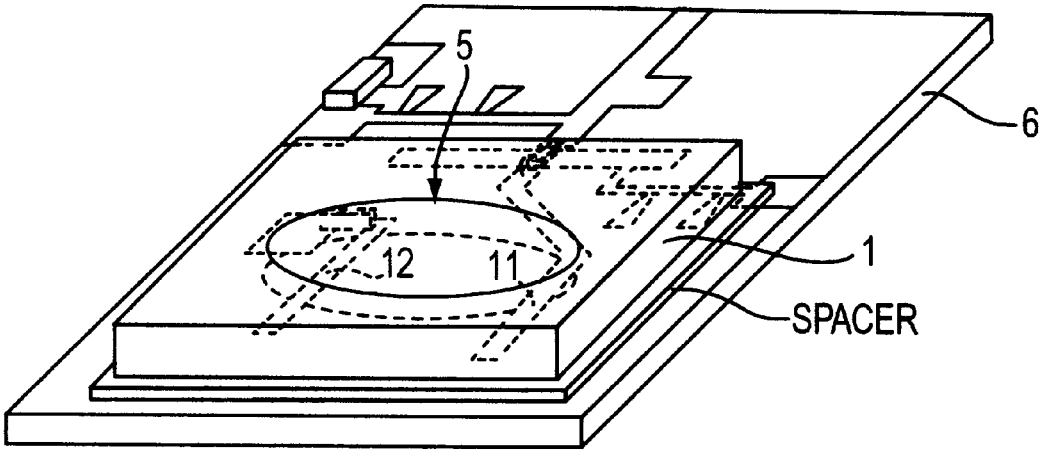
FIG. 20 PRIOR ART
FIG. 20 is a partial perspective view illustrating another example of the construction of a conventional VCO.

FIGS. 15A and 15B illustrate an electromagnetic field distribution in the PDTL-mode dielectric resonator. By disposing the coupling line 11 shown in FIG. 14 in a direction crossing the direction of the magnetic field in the PDTL mode, it is possible to magnetically couple the dielectric resonator with the coupling line.

What is claimed is:

1. A dielectric resonant apparatus including a dielectric resonator including electrodes formed on respective two main surfaces of a dielectric sheet, each said electrode having an opening formed at a location corresponding to the location of the opening formed in the other electrode, said dielectric resonant apparatus being characterized in that:

a coupling line coupled with said dielectric resonator is disposed in at least one of said openings and directly on the corresponding surface of the dielectric sheet; and a transmission line is formed outside said at least one of said openings; wherein said transmission line is electrically connected to said coupling line.

2. A dielectric resonant apparatus according to claim 1, wherein said transmission line is constructed in the form of a coplanar line using, as a ground electrode, one of said electrodes formed on said dielectric sheet.

3. A dielectric resonant apparatus according to claim 1, wherein:

on the surface of said dielectric sheet, there is disposed another dielectric sheet or dielectric film; and a microstrip line is formed on said another dielectric sheet or dielectric film such that said microstrip line serves as said transmission line.

4. A dielectric resonant apparatus according to claim 1, wherein said transmission line and said coupling line are electrically connected to each other via a conductor formed on an interconnecting member disposed on the surface of said dielectric sheet, said conductor being insulated from the electrode on the main surface of said dielectric sheet.

5. A dielectric resonant apparatus according to claim 2, wherein the center conductor of said coplanar line and said coupling line are constructed in the form of a single line.

6. A dielectric resonant apparatus according to claim 2, wherein two ground electrodes located at both sides of the center conductor of said coplanar line are connected to each other via a conductor extending over said center conductor.

* * * * *